US009185478B2

(12) United States Patent
Minarik et al.

(10) Patent No.: US 9,185,478 B2
(45) Date of Patent: Nov. 10, 2015

(54) RUGGEDIZED SOUND SYSTEM

(75) Inventors: Ryan Andrew Minarik, Ladera Ranch, CA (US); Michael DiTullo, Carlsbad, CA (US); Quinn Slater Huffstetler, San Francisco, CA (US); Cormac Eubanks, San Francisco, CA (US); Anthony Meredeth, San Francisco, CA (US)

(73) Assignee: Definitive Technology, LLC, Owings Mills, MD (US)

( * ) Notice: Subject to any disclaimer, the term of this patent is extended or adjusted under 35 U.S.C. 154(b) by 320 days.

(21) Appl. No.: 13/620,802

(22) Filed: Sep. 15, 2012

(65) Prior Publication Data

US 2014/0079264 A1 Mar. 20, 2014

(51) Int. Cl.
*H04R 1/02* (2006.01)

(52) U.S. Cl.
CPC ..... *H04R 1/023* (2013.01); *H04R 2420/07* (2013.01)

(58) Field of Classification Search
None
See application file for complete search history.

(56) References Cited

U.S. PATENT DOCUMENTS

| | | | | |
|---|---|---|---|---|
| 7,871,179 | B1 * | 1/2011 | Edgar | 362/197 |
| 2004/0108348 | A1 * | 6/2004 | Barnes | 224/413 |
| 2006/0259434 | A1 * | 11/2006 | Vilcauskas et al. | 705/57 |
| 2009/0169046 | A1 * | 7/2009 | Wu | 381/394 |
| 2010/0030698 | A1 * | 2/2010 | Goodin | 705/76 |
| 2011/0069855 | A1 * | 3/2011 | Tokuda et al. | 381/334 |
| 2012/0134518 | A1 * | 5/2012 | Otani et al. | 381/189 |
| 2013/0078855 | A1 * | 3/2013 | Hornick et al. | 439/571 |

FOREIGN PATENT DOCUMENTS

| | | | | |
|---|---|---|---|---|
| JP | 11347258 A | * | 12/1999 | A63H 5/00 |
| JP | 3165078 | * | 1/2011 | H04R 1/12 |

OTHER PUBLICATIONS

Staff, "Audio Bike a Handlebar Mounted Stereo Speaker—An Unnecessary but Cool Idea" U.S. Cycling Report, http://uscyclingreport.com/content/index.php?option=com_content&task=view&id=2489&Itemid=33, screen capture Jan. 4, 2013.
"Handlebar Mount Kit", BoomBotix, Inc., http://store.boombotix.com/products/handlebar-mount-kit, screen capture Jan. 4, 2013.
"GoPro", Woodman Labs, Inc., http://gopro.com/products/, screen capture Jan. 4, 2013.
"iLuv iSP11o 3.5mm Aux Portable Speaker Case (Blue)", http://www.amazon.com/iLuv-iSP110-3-5mm-Portable-Speaker/dp/B002QPQNLC/ref=sr_1_1?ie=UTF8&qid=1357275599&sr=8-1&keywords=iLuv+portable+amplified+speaker+case, screen capture Jan. 4, 2013.

* cited by examiner

*Primary Examiner* — Wayne Young
*Assistant Examiner* — Mark Fischer
(74) *Attorney, Agent, or Firm* — Fish & Tsang LLP

(57) ABSTRACT

A sound system configured to play audio files in a variety of indoor and outdoor environments is disclosed. The system includes a housing, a speaker, a power supply, and a mounting attachment that provides protection for sensitive system components and allow the system to be securely attached to a variety of surfaces and objects.

20 Claims, 6 Drawing Sheets

Figure 2A

Figure 2B

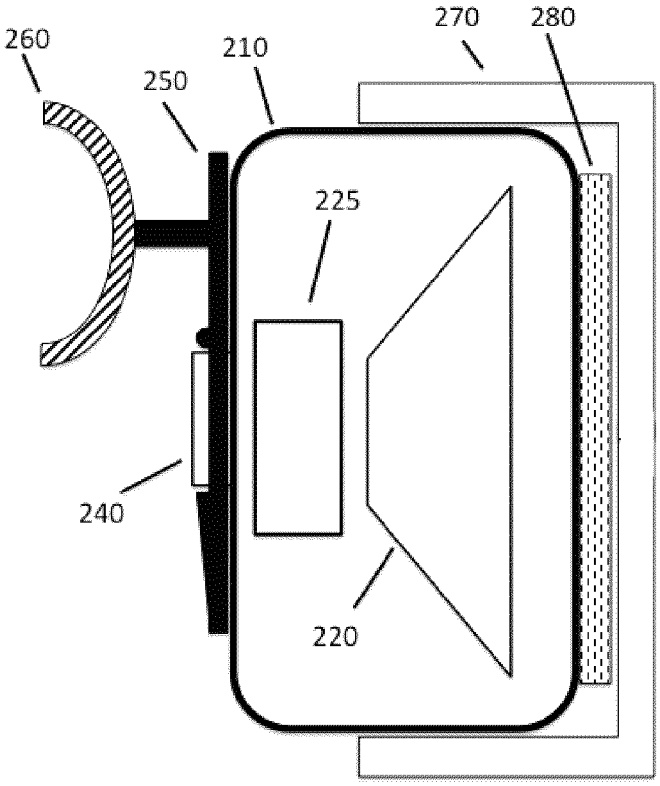
Figure 2A
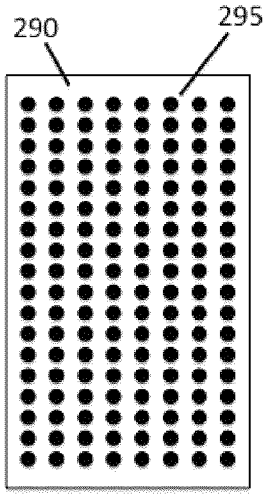
Figure 2B
Figure 2

RUGGEDIZED SOUND SYSTEM

FIELD OF THE INVENTION

The field of the invention is portable sound systems, in particular portable sound systems intended for use in outdoor environments.

BACKGROUND

The following background discussion includes information that could be useful in understanding the present inventive subject matter. It is not an admission that any of the information provided herein is prior art or relevant to the presently claimed inventive subject matter, or that any publication specifically or implicitly referenced is prior art.

Personal sound systems and similar electronic devices are growing rapidly in popularity, permitting users to enjoy music, audiobooks, and other forms of auditory entertainment without being tethered to a home system. Use of such devices while commuting, bicycling, and enjoying other activities outside of the home is commonplace. As the quality of sound reproduction improves, such devices are also beginning to replace traditional large, fixed units in the home with portable devices that are carried from room to room.

Portability generally requires that such a system be compact and lightweight, however this goal is often at odds with the necessity of ruggedizing such a system against accidental impacts, moisture, dust, and other environmental insults. Speakers are generally relatively fragile components of sound systems, and are particularly susceptible to damage from such events. A wide variety of manufacturers address this issue by supplying their system with earbuds or headphones that affix to the user's head in place of a conventional speaker. Unfortunately, use of such devices also block the user's perception of ambient sounds, presenting a sufficient safety hazard that their use is prohibited when operating motor vehicles in many jurisdictions.

Provision of a rugged sound system that broadcasts sounds to the ambient environment while allowing the user to hear necessary warning sounds is therefore desirable. However, the relative fragility of some system components presents a considerable impediment to designers. Some manufacturers have attempted to address this by providing various structures and mounts to stabilize and protect such systems. For example, the iLuv™ iSP110 and the iKross™ Portable Amplified Speaker Case provide a soft case that includes a speaker covered with a grate and a clip attached by a tether, which could be used to prevent the system from being dropped. Audio Bike™ systems supplies speakers, which could be used with personal audio players, in rigid casings that insert into the hollow interior of a bicycle's handlebars, preventing them from being dislodged and impacting the ground during use. These casings include piercings across a portion of the upper surface at one end of the case for transmission of sound. Similarly, BoomBotix™ supplies a device that clamps around the exterior of a bicycle's handlebars, allowing a user to mount a speaker covered by a protective grate to a bicycle. A similar mount is available for the GoPro™ camera systems (which have audiovisual recording and playback ability); GoPro also provides a variety of other mounting accessories that attach to various points on the camera's casing.

Unfortunately, these approaches do not provide a solution to the problem of providing a sound system that provides high quality sound reproduction and is adaptable for use across a wide variety of operating environments. Efficient broadcast of sound to the ambient environment requires a means to transmit sound waves generated by a speaker to the environment outside of the system with the least resistance possible. This need, however, is at odds with the need to protect sensitive system components. The grates disclosed in the systems noted above sometimes permit sound to move relatively freely but do not appear to provide a high degree of protection. The pierced, rigid casings of the Audio Bike speakers provide some protection, but their insertion into the handlebar necessary greatly limits the area through which sound could be transmitted. Devices that secure sound systems can provide a certain degree of protection by reducing the incidence of impacts. However it is desirable that their design also incorporate features that minimize their impact on sound reproduction. Flexible mounts such as the tethers of the iLuv iSP110 and the iKross Portable Amplified Speaker Case unfortunately leave ample opportunities for side impacts. Mounting systems designed for affixing a sound system to a specific object, such as those disclosed by the BoomBotix and Audio Bike systems, necessarily do not provide a general solution to securing a sound system, whereas the mounting system disclosed by the GoPro product line merely provides fixation without addressing audio performance.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

Thus, there is still a need for a durable sound system that can provide accurate reproduction of sounds across a wide variety of operating environments both inside and outside of the home or office.

SUMMARY OF THE INVENTION

The inventive subject matter provides apparatus, systems and devices that provide a durable audio or sound system that is capable of operating effectively in a wide variety of operating environments. The system includes a housing that has an exterior surface with at least one opening, one or more speakers, a power source, at least one mounting accessory, and a coupling for attaching the mounting accessory or accessories. An environmental barrier could be present and positioned to inhibit the passage of moisture through the opening or openings in the housing. The opening or openings, which serve to transmit sound from the speaker, occupy 10% or more of the surface of the sound system. In some embodiments the opening or openings occupy at least 30% of the surface of the sound system. The housing can also define an interior space, at least 30% of which could be occupied by a speaker.

The system includes a variety of mounting accessories that permit it to be mounted to a variety of objects or surfaces. Suitable mounting accessories include strap and non-strap accessories, including for example, a suction cup, an adhesive pad, a hook-loop fastener, a magnet, a handlebar mount, and a clamp. The system could include one, two, three, four, or more of mounting accessories. Alternatively, the sound system could be used without a mounting accessory (e.g., on a table, dashboard, etc.).

As used herein, the term "non-strap accessory" means a mounting accessory that is not coupled with a strip of flexible material. Non-strap accessories could be coupled to materials other than a strip of flexible material, including for example, a metal, a rubber or a plastic (e.g., a cylindrical piece of material, a keyring, etc.).

As an additional protective measure, the system could include an outer shell that encompasses at least 50% of the surface of the housing. In such an embodiment the housing can have one or more primary openings and the outer shell can include one or more secondary openings. The environmental barrier described above could be positioned between the housing and the outer shell.

In addition to a speaker, the system could also include devices such as a wireless communication device that can receive an audio file, digital memory for storage of audio data, and/or a geographic positioning system and associated wireless electronics.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 2 is representation of an embodiment of a sound system of the inventive subject matter. FIG. 2A shows a cutaway view of a housing with a speaker, a suction cup mounting device, and an external shell. FIG. 2B shows a view of the surface, with multiple openings that occupy a portion of the surface area of the external shell.

FIG. 3A shows a mounting accessory featuring an adhesive pad. FIG. 3B shows a mounting accessory featuring a magnet.

DETAILED DESCRIPTION

Figures 1, 1A, 1B:
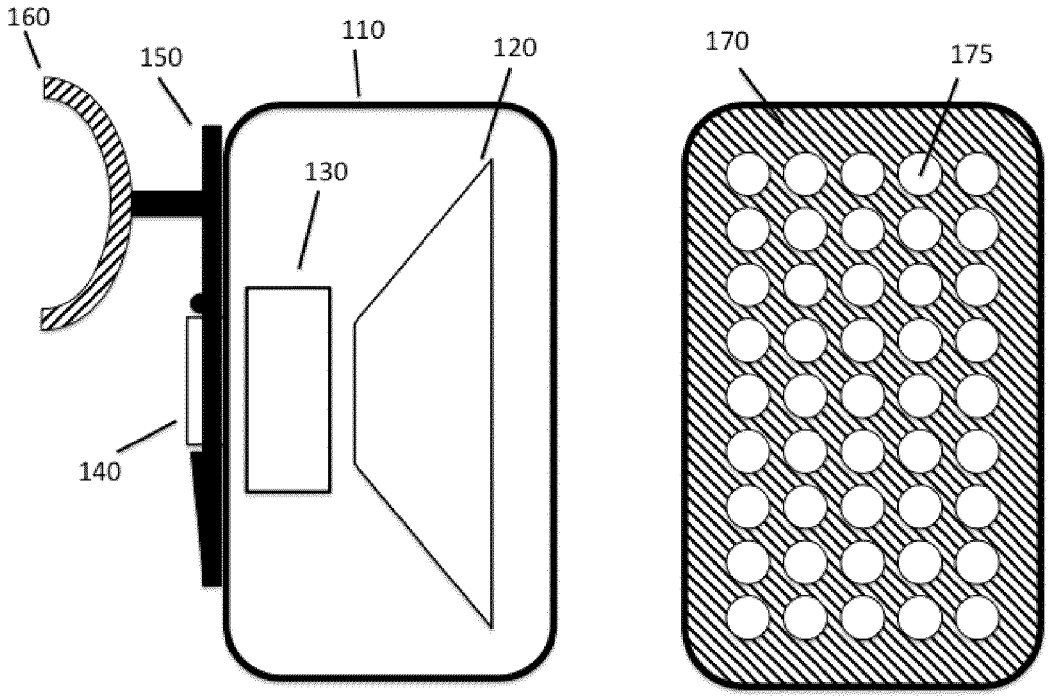
FIG. 1 is a representation of an embodiment of a sound system of the inventive subject matter.
FIG. 1A shows a cutaway view of a housing with a speaker and a suction cup mounting device.
FIG. 1B shows a view of the surface, with multiple openings that occupy a significant portion of the surface area of the housing.

The inventive subject matter provides apparatus, systems and devices that provide a portable sound system that could be used in a wide variety of environments both inside and outside of the home.

Preferably, a system of the inventive subject matter could be used with reduced or eliminated fear of damage, providing sound to the ambient environment where it could be enjoyed without the need for accessories such as headphone or earbuds. This could be achieved using a combination of (1) a housing with both protective features and features designed to optimize acoustic performance, and (2) through the use of mounting accessories. The system could include a protective outer shell that acts in concert with the housing to provide further protection from impacts and other damage that are the inevitable consequence of regular, active use.

It should be noted that while the following description is drawn to ruggedized audio or sound systems, various alternative configurations are also deemed suitable and could employ various audio devices including compact disc players, AM/FM radios, personal digital audio players, tablet computing devices, mobile telephones, or other types of audio devices operating individually or collectively. The terms audio system and sound system are considered to be synonymous within this application. One should appreciate the audio devices could comprise a processor configured to access audio files and execute software instructions stored on a tangible, non-transitory computer readable storage medium (e.g., hard drive, solid state drive, RAM, flash, ROM, etc.). The audio devices could be configured to receive audio files by a variety of means, including physical media, cable connections, data ports, wireless transmission, or other forms of data transmission operating individually or collectively. Such audio files could be played as they are received or read, stored in the aforementioned computer readable storage medium, temporarily compiled and played without storage (i.e. streaming), or a combination of these.

One should appreciate that the disclosed techniques provide many advantageous technical effects including providing a single portable sound system that allows a user to enjoy their audio files or other audio (e.g., AM/FM radio, satellite radio, etc.) in a wide variety of domestic and outdoor settings without resorting to earbuds or headphones, which can be uncomfortable and present safety concerns in many settings. These advantages could thereby relieve the user of the burden of owning multiple sound systems and maintaining corresponding multiple audio file collections. In addition to advantageously allowing the user to readily perceive important environmental sounds, such as sirens, automobile horns, doorbells, ringing telephones, etc., the system allows for the use of multiple speakers that could allow more accurate reproduction of sound. The sound system also permits enjoyment of audio streams in moist or wet environments where conventional sounds systems, earbuds, and headphones could be damaged.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As noted above, a system of the inventive concept provides a protective housing that encases system components, which could include one or more speakers. The housing could comprise any suitable material, including but not limited to rigid and semi-rigid plastics, a rubber, a silicone, a foam, a metal, a wood, or any combination thereof. If more than one speaker is used, they could be essentially identical to one another, or could be selected to provide accurate sound reproduction in different frequency ranges. In many instances the use of large speakers is desirable for accurate reproduction of low frequency sounds, with smaller speakers providing more accurate sound reproduction at higher frequencies. As a result, a significant portion of the internal volume of the housing of a sound system of the inventive subject matter could be occupied by one or more speakers.

In some aspects of the inventive subject matter, a speaker could occupy at least about 10%, 20%, 30%, 40%, 50%, 60%, 70%, 80%, or more of the internal volume of the housing. In some aspects of the inventive subject matter, the housing incorporates one or more openings that improve the acoustic performance of the system by easing transmission of sound from a speaker to the external environment. These openings, either individually or collectively, could occupy a significant fraction of the surface area of the housing in order to provide optimal sound transmission. An opening or set of openings could, individually or collectively, could occupy at least about 10%, 15%, 20%, 25%, 30%, 35%, 40%, 45%, or 50% or more of the surface area of the housing. Multiple openings could be arranged to provide optimal sound transmission, for example, in a spiral or circular pattern. Alternatively, openings in the housing could serve the dual purpose of easing the transmission of sound from the speaker to the ambient environment, and providing a degree of flexibility in the housing that minimizes the shock of impacts.

The system could include an outer shell. This outer shell could comprise any suitable material, including but not limited to rigid and semi-rigid plastics, a rubber, a silicone, a foam, a metal, a wood, or any combination thereof. The outer shell and the housing could be made of the same or different material(s).

It is contemplated that the outer shell could partially encase a housing and serve as an additional layer of protection. The outer shell could encase at least about 30%, 40%, 50%, 60%, 70%, 80% or more of the housing.

It is contemplated that the outer shell could include one or more openings. In such an embodiment an opening of the housing could be termed a primary opening while an opening of the outer shell could be termed a secondary opening. The secondary opening or openings could, individually or collectively, occupy at least about 10%, 15%, 20%, 25%, 30%, 35%, 40%, 45%, or 50% or more of the surface area of the outer shell. The size and distribution of the secondary openings could differ from those of the primary openings. Multiple secondary openings could be arranged to provide optimal sound transmission, for example, in a spiral or circular pattern. Alternatively, secondary openings in the outer shell could serve the dual purpose of easing the transmission of sound from the speaker to the ambient environment, and providing a degree of flexibility in the housing that minimizes the shock of impacts. While at least partially encompassing the housing, the outer shell could come into contact with only a portion of the housing. This arrangement advantageously enhances the protective function of the outer shell by providing a space into which the outer shell could intrude during impact, reducing the shock of impacts on the system.

A system of the inventive subject matter could comprise a protective environmental barrier. This environmental barrier could comprise any suitable material, including but not limited to plastic foam, foam rubber, porous fabrics, aerogel, silicone, or any combination thereof. A protective barrier could serve to reduce the transmission of materials that could harm system components, for example moisture, from the environment to the interior volume of the housing while being sufficiently porous to minimally impact the transmission of sound from the interior of the housing. As such, the protective barrier could be placed in close proximity to the housing. In some embodiments the protective barrier could be located within the interior volume of the housing. In other embodiments the protective barrier could be interposed between the housing and the outer shell. In such an embodiment the protective barrier could advantageously serve a dual role or reducing the transmission of materials from the environment to the interior of the housing and of absorbing shocks resulting from impacts to the system.

Perhaps the most common source of unintentional impacts on portable sound systems is from simply being dropped. This can be avoided by utilizing a mount to secure the system to a convenient attachment point or surface. In one aspect of the inventive subject matter the system provides a coupling or attachment point and a variety of mounting accessories that interface with the coupling or attachment point and that advantageously permit the system to be utilized in a wide variety of indoor and outdoor settings. It should be appreciated, however, that while it helps to protect a sound system, both the position and method of mount can impact a sound system's performance. Optimal reproduction of sound is dependent on both the accurate reproduction of sound by a speaker and the acoustic properties (such as resonance) of the speaker's immediate surroundings (i.e. the housing). The site of the attachment point or coupling for the mounting accessory could, therefore, be selected so that the system could be both safely secured and the acoustic properties of the housing minimally impacted. In some embodiments the system could have one or more attachment point(s) or coupling(s) where mounting accessories could be affixed to the housing. In other embodiments the system has one or more attachment point(s) or coupling(s) where mounting accessories could be affixed to the outer shell.

As noted above, a system of the inventive subject matter could include a plurality of mounting accessories. Mounting accessories included with the system could include accessories intended for use in different mounting scenarios, and could include, but not be limited to, suction cups, adhesive pads, hook-loop closures, magnets, handlebar mounts, clamps, or tripods or similar stands. A mounting accessory could be unitary structures that interface with an attachment point or coupling. Alternatively, mounting accessories could be modular structures, for example, a structure comprising a stem portion that interfaces with both a coupling of the system and a number of mounting elements (ex: a suction cup, an adhesive pad, a hook-loop device, a magnet, a handlebar mount, a clamp, a tripod or similar stand). It should be noted that some mounting accessories could include portions that can potentially interfere with the performance of other components of the sound system of the inventive subject matter. For example, the magnet of a magnetic mount could interfere with the performance of electronic components of the system. Mounting accessories could, therefore, include design elements that prevent interference between a mounting element and other components of the sound system.

In FIGS. 1A and B, an embodiment of the inventive subject matter is shown. As shown in the cutaway view of FIG. 1A, a housing 110 encloses a speaker 120 and a power supply 130. The housing also includes a coupling 140 for a mounting accessory 150. The position of the coupling 140 has been selected to provide both stability and to minimize interference with the acoustic properties of the housing 110. The mounting accessory 150 includes a suction cup 160 that permits secure attachment of the sound system to smooth surfaces. FIG. 1B shows an external view of the front face of the housing 110, displaying its external surface 170. A number of openings 175 can be seen that occupy a significant fraction of the total surface area of the housing, which both permits sound to escape from the interior of the housing 110 to the ambient environment and provide an enhanced flexibility to this portion of the housing 110 that helps minimize the shock of accidental impacts. An environmental barrier (not shown) could be included in the housing 110 to prevent transfer of hazards from the environment, such as moisture, to the interior of the housing 110.

An alternative embodiment of the inventive subject matter is shown in FIGS. 2A-B. As shown in the cutaway view of FIG. 2A, a housing 210 encloses a speaker 220 and a power supply 225. The housing also includes a coupling 240 for a mounting accessory 250. The position of the coupling 240 has been selected to provide both stability and to minimize interference with the acoustic properties of the housing 210. The mounting accessory 250 includes a suction cup 260 that permits secure attachment of the sound system to smooth surfaces. The system includes a protective outer shell 270 that encompasses a significant portion of the housing 210 and provides an additional layer of protection. As shown, the outer shell 270 contacts only a portion of the surface of the house 210 that is encompassed, providing a space that affords additional protection from the shock of accidental impact. An environmental barrier 280 is shown interposed between the housing 210 and the outer shell 270, which serves to prevent moisture from entering the housing 210. Such an environmental barrier 280 can have sufficient give to absorb shock from accidental impact that is transmitted through the outer shell 270, thereby serving a dual role. FIG. 2B shows an external view of the front face of the outer shell 270, displaying its external surface 290. A number of openings 295 can be seen that occupy a significant fraction of the total surface area of the outer shell, which both permits sound to escape from the interior of the housing 210 to the ambient environment and provide an enhanced flexibility to the outer shell 270 that helps minimize the shock of accidental impacts.

Figure 3:
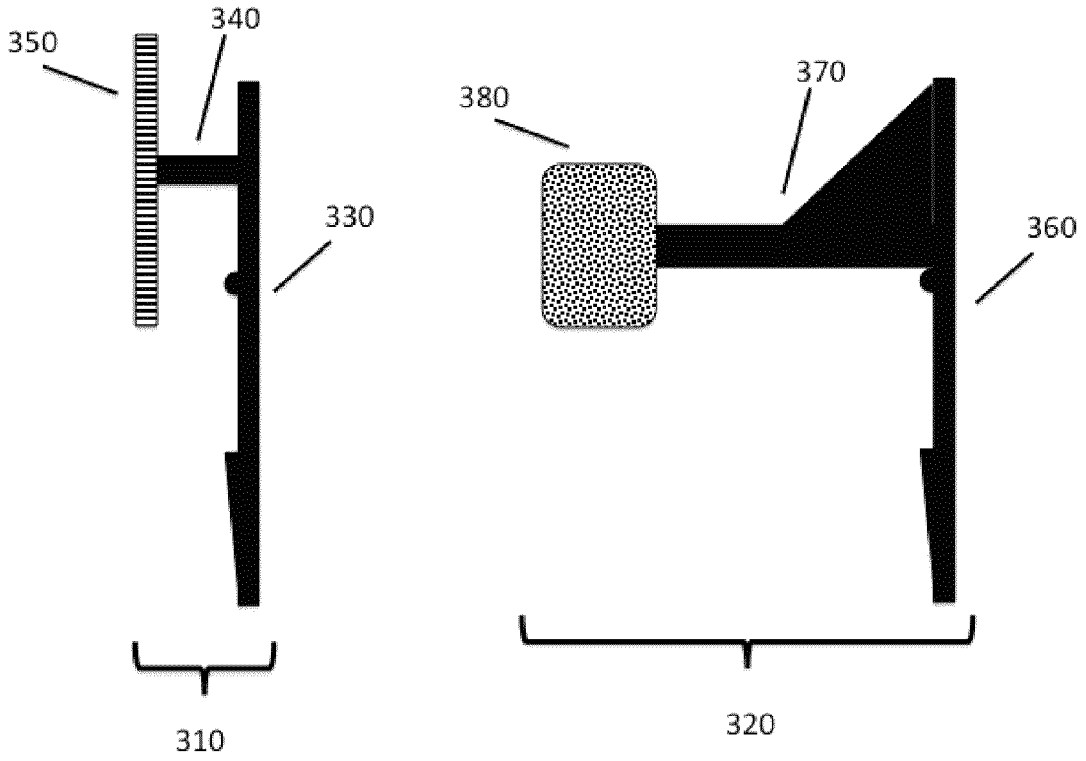
FIG. 3 shows additional mounting accessories.

Additional examples of mounting accessories are shown in FIG. 3. An adhesive mounting accessory 310, which could be used with porous surfaces, includes a coupling interface 330, a stem 340, and an adhesive pad 350. A magnetic mounting accessory 320, which could be used with magnetic or paramagnetic surfaces, includes a coupling interface 360 that is substantially similar to that of the adhesive mounting accessory 310. The stem 370 of the magnetic mounting accessory 320 shows design changes to accommodate the need to reduce the potential for interference from the magnet 380 with other components of a sound system. The length of the magnetic mount stem 370 is greater than that of the adhesive mount stem 340 in order to reduce magnetic field strength from the magnet 380 within the housing; in addition the magnetic mount stem 370 is reinforced in order accommodate the increased moment arm that is a consequence of this greater length.

Figure 4:
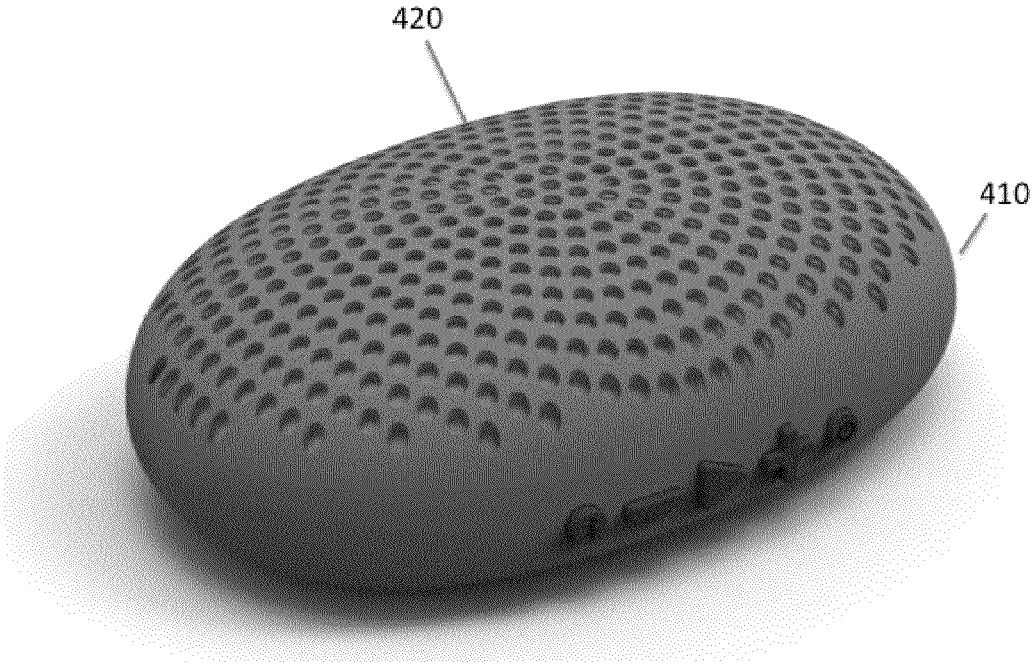
FIG. 4 depicts an external perspective view of an embodiment of a sound system of the inventive subject matter.
Figure 5:
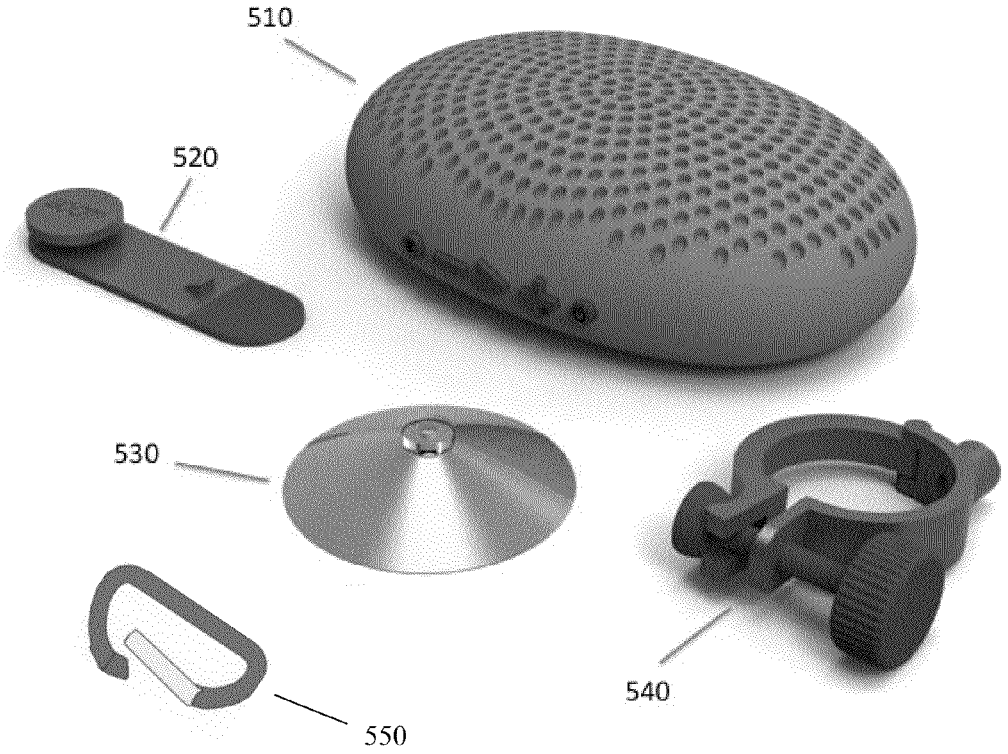
FIG. 5 depicts an external perspective view of a sound system of the inventive subject matter with mounting accessories.
Figure 6:
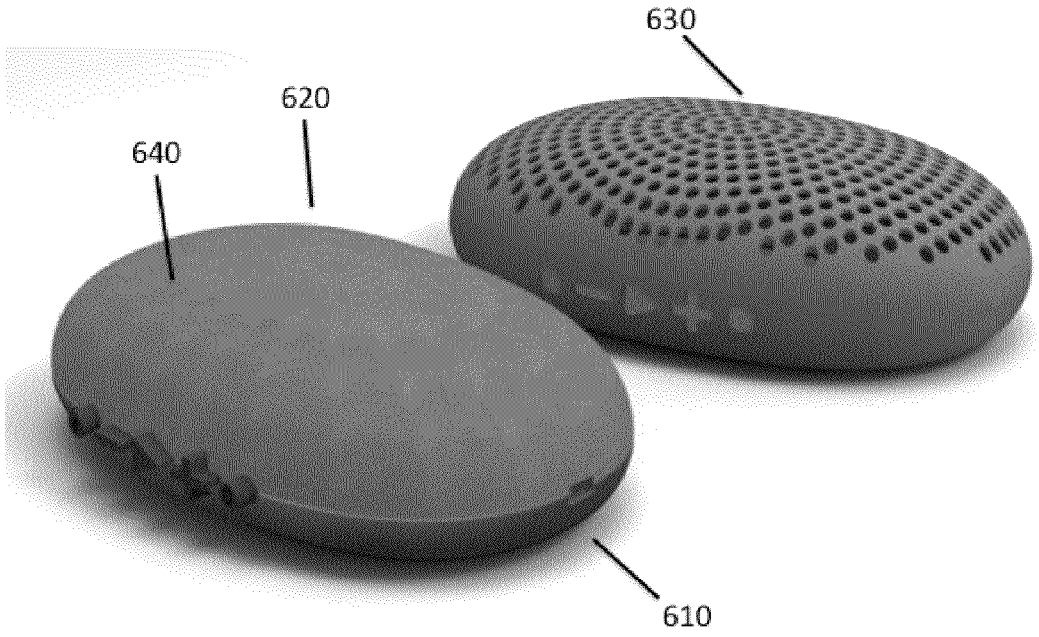
FIG. 6 shows a sound system of the inventive concept with the protective outer shell removed, exposing an environmental barrier.

FIGS. 4-6 show views of an embodiment of the inventive subject matter. FIG. 4 shows an external view of a ruggedized sound system of the inventive subject matter, with an outer shell 410 that includes a number of openings 420. FIG. 5 shows an external view of a ruggedized sound system 510 of the inventive subject matter from a different angle, along with examples of mounting accessories. A coupling interface 520 is shown that could be used with a suction cup 530, a bicycle handlebar mount 540, or a carabiner 550.

FIG. 6 shows a view of a sound system of the inventive subject matter where the outer shell 630 has been removed from the housing 610. An environmental barrier 620 can be seen covering a portion of the surface of the housing, positioned to prevent movement of materials from the environment, such as moisture, moving through the primary openings 640 of the housing 610. In this position the environmental barrier 620 could also supply friction to aid in holding the external shell 630 in position when mounted on the housing 610, and can also act to absorb shock from accidental impacts to the outer shell 630.

Shell 630 preferably comprises a rubber or other impact absorbing material designed to give a "ruggedness" to the sound system. Suitable impact absorbing materials include gels, air cells, and polymeric foams such as polyethylene and visco-elastic polyurethane, which have impact attenuation of at least 70% that of Sorbothane™. These are preferably utilized with a thickness of at least 1 mm and more preferably at least 2 mm or at least 3 mm. Currently a preferred material for shell 630 is a silicone rubber, using a thickness of approximately 2.25 mm.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps could be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A sound system comprising:

a housing enclosing a first speaker and including a first plurality of openings extending across at least 40% of an entire outer surface of the housing, and wherein the first speaker is disposed in the housing to provide sound through the plurality of opening;

a removable outer shell that encompasses at least 50% of the area of the entire outer surface and includes a second plurality of openings, and wherein the removable outer shell comprises at least one of a rubber, a gel, an air cell material, a polymeric foam, and a silicon;

an environmental barrier distinct from the outer shell and disposed between the housing and the outer shell, wherein the environmental barrier encompasses the first plurality of openings extending across at least 40% of the entire outer surface and is configured to inhibit the passage of moisture through the first plurality of openings;

a power source that provides power to the speaker;

a plurality of non-strap mounting accessories; and wherein the housing includes a coupling that interchangeably receives each of the plurality of accessories.

2. The sound system of claim 1, wherein the plurality of mounting accessories includes at least two of the group consisting of a suction cup, an adhesive pad, a hook-loop fastener, a magnet, a handlebar mount, a clamp and a carabiner.

3. The sound system of claim 1, wherein the first speaker is the only speaker enclosed in the housing.

4. The sound system of claim 1, wherein removable outer shell is flexible.

5. The sound system of claim 1, further comprising a wireless communication electronics through which an audio file can be received by the system.

6. The sound system of claim 1, further comprising a geographic positioning system, and electronics configured to wirelessly disclose a geographic position of the system.

7. The sound system of claim 1, further comprising a digital memory that stores audio data played through the speaker.

8. The sound system of claim 1, wherein the housing defines an interior space comprising at least one compartment, and where the first speaker occupies at least 30% of the space.

9. The sound system of claim 1, wherein the environmental barrier has sufficient give to absorb shock from an accidental impact that is transmitted through the removable outer shell.

10. The sound system of claim 1, wherein the first plurality of openings extends across at least 45% of the surface area of the entire outer surface.

11. A sound system comprising:

a housing enclosing a first speaker and including a first plurality of openings, extending across at least 25% of an entire outer surface of the housing;

a removable outer shell that encompasses at least 50% of the area of the entire outer surface and that includes a second plurality of openings;

wherein the first speaker is configured to provide sound through the first plurality of openings and at least some of the second plurality of openings;

an environmental barrier distinct from the outer shell and disposed between the housing and the outer shell, wherein the environmental barrier encompasses the first plurality of openings extending across at least 25% of the entire outer surface and is, configured to inhibit the passage of moisture through the first plurality of openings;

a power source that provides power to the speaker;

a plurality of non-strap mounting accessories; and wherein the housing includes a coupling that interchangeably receives each of the plurality of accessories.

12. The sound system of claim 11 wherein the plurality of mounting accessories includes at least two of the group consisting of a suction cup, an adhesive pad, a hook-loop fastener, a magnet, a handlebar mount, and a clamp.

13. The sound system of claim 11, wherein the removable outer shell comprises at least one of a rubber, a gel, an air cell material, a polymeric foam, and a silicone.

14. The sound system of claim 11, wherein the removable outer shell is flexible.

15. The sound system of claim 11, further comprising a wireless communication electronics through which an audio file can be received by the system.

16. The sound system of claim 11, further comprising a geographic positioning system, and electronics configured to wirelessly disclose a geographic position of the system.

17. The sound system of claim 11, further comprising a digital memory that stores audio data played through the speaker.

18. The sound system of claim 11, wherein the housing defines an interior space comprising at least one compartment, and where the first speaker occupies at least 30% of the space.

19. The sound system of claim 11, further comprising a second speaker disposed within the housing.

20. The sound system of claim 11, wherein the first plurality of openings extends across at least 30% of the surface area of the entire outer surface.

* * * * *